US006615813B1

(12) United States Patent
Troncoso, Jr. et al.

(10) Patent No.: US 6,615,813 B1
(45) Date of Patent: Sep. 9, 2003

(54) FALL AWAY ARROW REST

(75) Inventors: Fernando V. Troncoso, Jr., Montrose, CO (US); Vincent Troncoso, Montrose, CO (US)

(73) Assignee: Golden Key Futura, Inc., Montrose, CO (US)

( * ) Notice: Subject to any disclaimer, the term of this patent is extended or adjusted under 35 U.S.C. 154(b) by 0 days.

(21) Appl. No.: 09/714,567

(22) Filed: Nov. 16, 2000

(51) Int. Cl.[7] ..... F41B 5/22
(52) U.S. Cl. ..... 124/44.5
(58) Field of Search ..... 124/24.1, 25.6, 124/44.5

(56) References Cited

U.S. PATENT DOCUMENTS

| | | | | |
|---|---|---|---|---|
| 3,504,659 A | * | 4/1970 | Babington | |
| 4,287,868 A | * | 9/1981 | Schiff | |
| 4,748,963 A | | 6/1988 | Troncoso et al. | |
| 4,829,974 A | | 5/1989 | Anderson | |
| 4,865,007 A | | 9/1989 | Saunders | 124/44.5 |
| 5,161,515 A | | 11/1992 | Hammonds | 1124/44.5 |
| 5,365,912 A | * | 11/1994 | Pittman | 124/44.5 |
| 5,394,858 A | * | 3/1995 | Karolian | 124/44.5 |
| 5,415,154 A | | 5/1995 | Angeloni | 124/44.5 |
| 5,460,152 A | | 10/1995 | Specht | 124/44.5 |
| 5,490,492 A | | 2/1996 | Savage | 124/44.5 |
| 5,529,049 A | | 6/1996 | Antalosky | 124/44.5 |
| 5,601,069 A | | 2/1997 | Clark | 124/44.5 |
| 5,606,961 A | | 3/1997 | Basik et al. | 124/44.5 |
| 5,632,263 A | * | 5/1997 | Sartain | 124/44.5 |
| 5,915,369 A | | 6/1999 | Sheliga | 124/44.5 |
| 5,944,005 A | | 8/1999 | Schiff | 124/44.5 |
| 6,035,842 A | * | 3/2000 | Bradley | 124/44.5 |
| 6,044,832 A | | 4/2000 | Piersons, Jr. | 124/44.5 |

* cited by examiner

*Primary Examiner*—John A. Ricci

(57) ABSTRACT

A fall away arrow rest in which the launcher arm normally extends upwardly and forwardly in the arrow window and is adapted to fall immediately downwardly under spring bias upon firing the arrow. The arrow rest includes a mechanism for maintaining the launcher arm in the substantially upward position during substantially the entire draw of the arrow.

26 Claims, 4 Drawing Sheets

FALL AWAY ARROW REST

FIELD OF THE INVENTION

The present invention generally relates to archery, and more particularly, to fall away arrow rests.

BACKGROUND OF THE INVENTION

Archery bows, such as compound bows, conventionally possess a handle riser section generally where an archer grasps the bow with one of the archer's hands. The handle riser section includes a window section through which an arrow extends when the arrow is drawn rearwardly as the bowstring is drawn and momentarily after releasing the bowstring and during the initial firing of the arrow.

When an arrow is fired, the arrow both bends and is thrust downwardly. A number of arrow rests have been designed to help absorb any downward or sideward flexing or any downward thrust of the arrow in order to improve arrow flight accuracy. Many of these arrow rests are designed to eliminate or minimize any potential contact of the arrow feathers or vanes with the arrow rest, which would cause the trajectory of the arrow to be altered.

While arrow rests are designed to avoid bumping of the arrow shaft or contact with the arrow vanes, such designs often do not accomplish those goals, because either the archery assembly is not well tuned, or the archer utilizes imperfect technique. For example, if the archer does not select a proper nocking point at which the nock of an arrow contacts the bowstring, if the stiffness or thickness of the arrow shaft or spine are not properly selected, if the arrow rest is located too high or too low or too much to the left or the right, if the resilience of the arrow rest is too stiff or too light, or if the length of the arrow in combination with the orientation of the arrow vanes (which may be slanted in order to spin) is not properly selected, then the arrow shaft or arrow vanes may forcibly contact the arrow rest in a way that significantly alters the trajectory of the arrow. Also, for example, the archer may improperly release the arrow upon firing, and the archer may subject the bow to some inadvertent horizontal or vertical movement that is transferred to the rest, each of which may cause the arrow shaft or arrow vanes to severely contact the arrow rest Many retractable or so-called "fall away" arrow rests have been designed so that when the arrow is fired, the arrow rest retracts or falls out of way of the arrow shaft and arrow vanes. Many of these designs suffer from some of the following disadvantages: the arrow rest does not retract or fall away immediately upon firing the arrow, the retractable fall away feature is cumbersome, or the arrow rest moves as the arrow is being drawn rearwardly.

SUMMARY OF THE INVENTION

The present invention relates to a fall away arrow rest in which the launcher arm normally extends upwardly and forwardly in the arrow window and is adapted to fall immediately downwardly under spring bias upon firing the arrow. The arrow rest includes a mechanism for maintaining the launcher arm in the substantially upward position during substantially the entire draw of the arrow.

BRIEF DESCRIPTION OF THE DRAWINGS

The invention will be described with reference to the accompanying drawings wherein.

DESCRIPTION OF A PREFERRED EMBODIMENT

Figure 1:
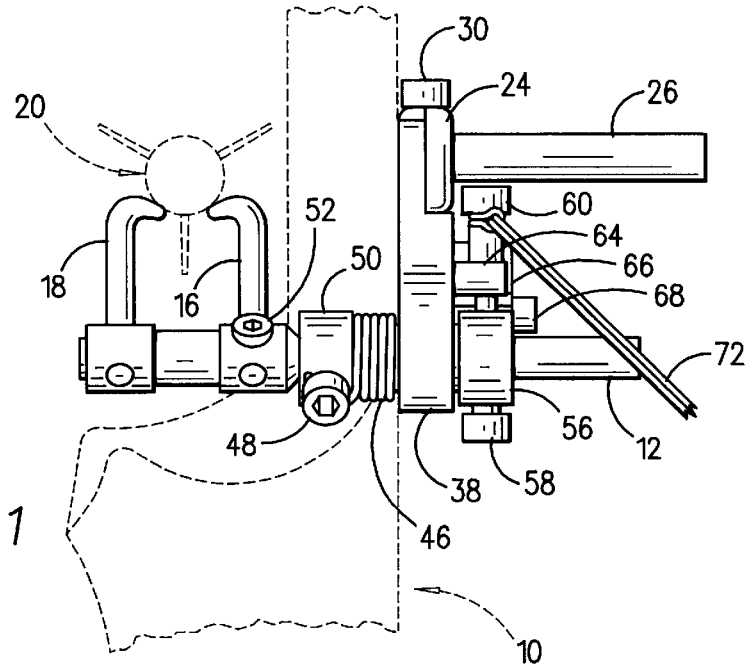
FIG. 1 is a schematic rear elevation of a fall away arrow rest in accordance with one embodiment of the present invention.
Figure 2A:
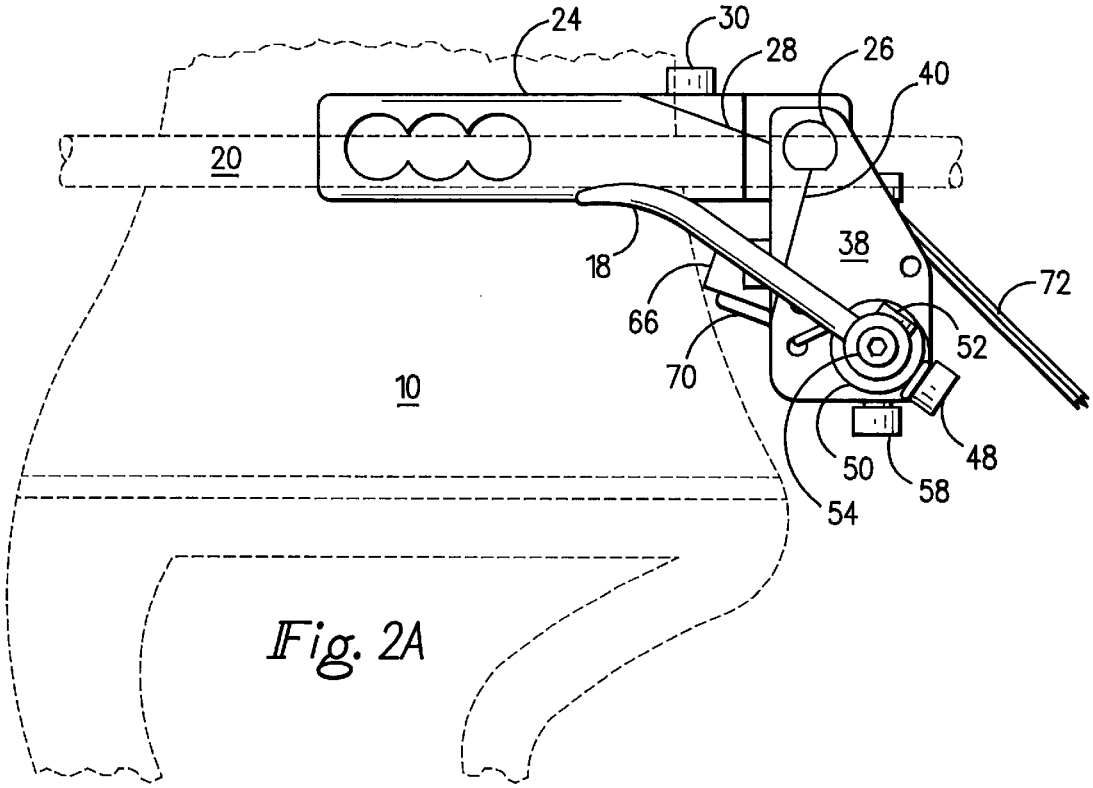
FIG. 2A is a schematic side elevation of the arrow rest as shown in FIG. 1.

The present invention will be described with reference to the accompanying drawings, wherein like reference numerals refer to the same item. There is shown in FIG. 1 in phantom lines an archery bow 10, which may be a compound bow or other type of bow. The portion of the bow 10 as shown in FIGS. 1 and 2A is generally known as the handle riser section, which includes an arrow window in which an arrow 20 is adapted to be disposed immediately prior to drawing the arrow, during the drawing of the arrow, and during the firing of the arrow from the bow 10.

The arrow rest of the present invention includes a base by which the arrow rest is adapted to be mounted to the bow 10. The base maintains a rotatable shaft 12 in a substantially horizontal or lateral orientation, with one end of the shaft 12 extending generally into the window region of the bow 10. Such shaft end supports a pair of laterally spaced support arms 16, 18, as best shown in FIGS. 1 and 2A. The support arms 16, 18 are preferably fashioned in the nature of prongs that extend forwardly and upwardly in a window region. The prongs are preferably fashioned of a rigid material and may be coated with plastic or TEFLON® to help reduce frictional engagement (and associated noise) of the prongs with the arrow shaft when the arrow 20 is drawn and fired. The tips of the support arms 16, 18 are tapered and rounded and are curved toward the adjacent support arm. As best shown in FIG. 1, the shaft or spine of the arrow 20 is adapted to rest upon and to be centered above the converging tips of the support arm 16, 18.

It should be appreciated that instead of a pair of laterally spaced support arms 16, 18, a single support arm having a forked or crotched upper end may be utilized to help cradle the arrow shaft in a selected position. Also, although rigid support arms are preferred, it is within the scope of the present invention that resiliently flexible support arms may also be utilized.

The base for supporting the rotatable shaft 12 and the support arm 16, 18 will now be described. The base includes a generally flat, metal mounting plate 24, which is adapted to be placed forcibly against the outside surface of the bow 10 along the handle riser section with bolts or screws, in a well-known manner. The mounting plate 24 generally comprises a rectangularly shaped body with three interconnected holes disposed near one end of thereof. The centers of the holes extend along a common line, and each hole possesses the same diameter. When the mounting plate 24 is secured by a bolt, screw, or the like to the handle riser section of the bow 10, the archer may select one of the three holes in which to place the bolt, screw, or the like, which will concomitantly cause the support arms 16, 18 to be adjustably positioned backwardly or forwardly within the window region of the bow 10.

Another hole extends laterally through the mounting plate 24 near the other end thereof. Such hole is adapted to receive a laterally extending metal rod 26. A straight line cut 28 is made in the mounting plate 24 from an upper surface thereof and inclined at an angle toward the hole in which the rod 26 is adapted to extend. A threaded cavity (shown in FIG. 4) extends from the upper surface of the mounting plate 24 through the cut line 28 and is adapted to receive a threaded screw 30. By tightening the threaded screw 30, the rod 26 is clamped within its associated hole within the mounting plate 24, whereas by loosening the screw 30, the rod 26 is unclamped, and may be translated in or withdrawn from such hole.

The base also includes a substantially vertically extending bracket 38. The bracket possesses an upper hole extending therethrough, which is adapted to receive an end of the rod 26. A straight line cut 40 is made in the front surface of the bracket 30 and inclined at an angle toward the hole in which the rod 26 is adapted to be received in the bracket 38. A threaded cavity (shown in FIG. 4) extends from the front surface of the bracket 38 through the cut line 40, and is adapted to receive a threaded screw 42. By tightening the threaded screw 42, the rod 26 is clamped within its associated hole within the bracket 38, and whereas by loosening the screw 42, the rod 26 is unclamped, and may be translated within or withdrawn from such hole.

It will be appreciated that by tightening and loosening the two screws 30 and 42, the bracket 38 may be rotated about the rod 26 relative to the mounting plate 24 and that the bracket may be laterally, adjustably spaced from the mounting plate 34 a selected distance, which in turn permits the archer to laterally adjust the position of the support arms 16, 18 in the window section of the bow 10.

Figure 4:
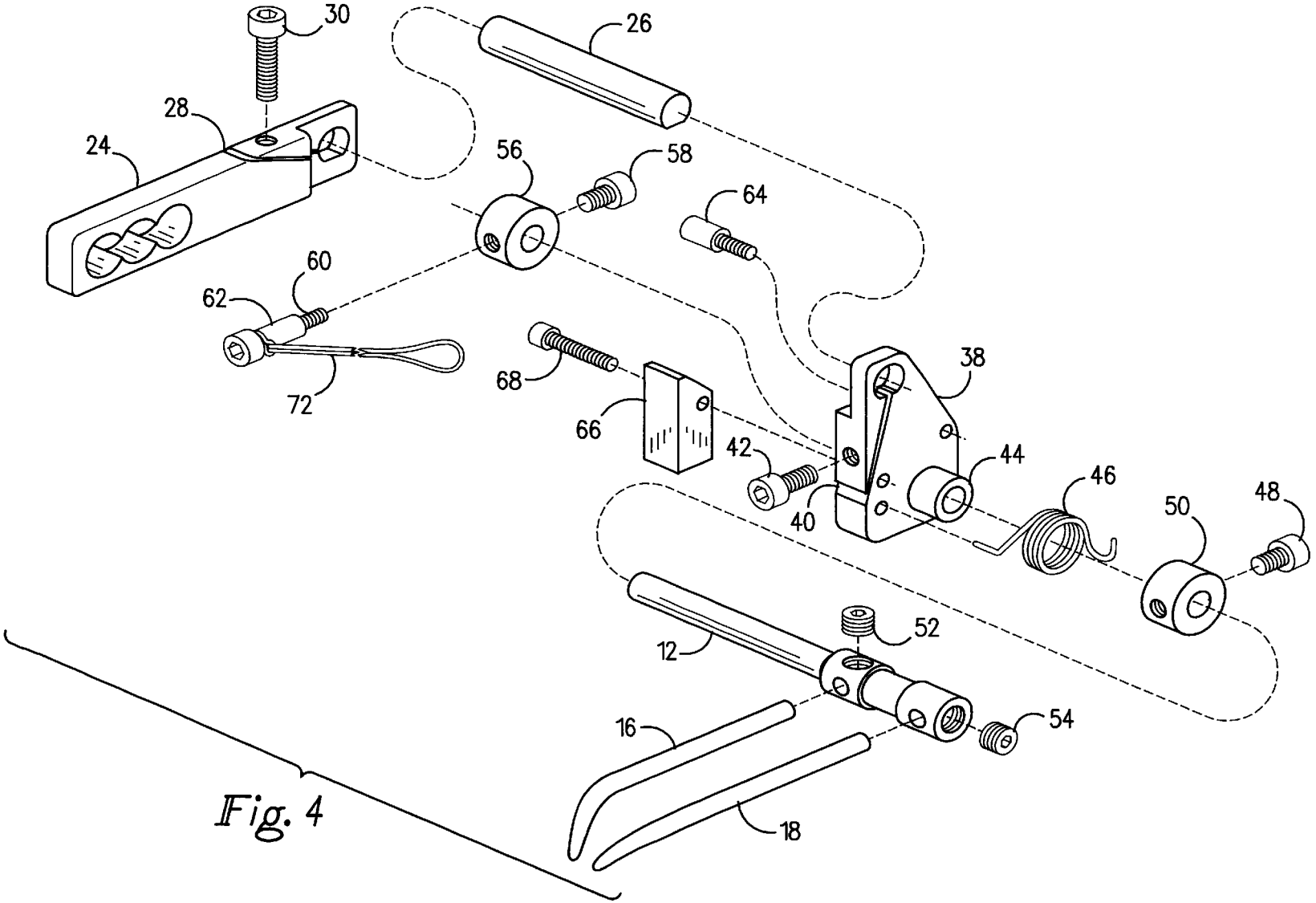
FIG. 4 is an exploded perspective view of the arrow rest illustrated in FIG. 1.

The bracket 38 also includes a lower hole extending therethrough, with an integrally molded collar 44 extending laterally from a lateral side of the bracket 38. Such lower hole in the bracket 38 and collar 44 are adapted to receive the shaft 12. A coil spring 46 is adapted to be mounted over the collar 44. One end of the coil spring 46 fashioned in the shape of a finger is adapted to extend into a corresponding hole located in the lower, forward portion of the bracket 38, as best shown in FIG. 4. The other end of the coil spring is generally fashioned in the shape of a crook, and is adapted to surround the head of a screw 48 that is adapted to extend into a threaded cavity radially extending through a second collar 50 also surrounding the shaft 12. The screw 48 is tightened so as to clamp the collar 50 with the shaft 12, whereby the collar 50 and the shaft 12 rotate concurrently. The collar 50 is positioned about the shaft 12 so as to compactly maintain the coil spring 46 against the bracket 38 such that the finger shaped end of the coil spring 46 is maintained within its associated hole in the bracket 38. The coiled spring 46 is adapted to strongly bias the support arms 16, 18 toward a rotationally downward position.

The end of the shaft extending generally into the window of the bow 10 possesses a relatively enlarged diameter region. The ends of the support arms 16, 18 opposite the curved ends extend through corresponding laterally spaced holes radially extending through the enlarged diameter end of the shaft 12, as best shown in FIG. 4. A threaded cavity radially extends into the enlarged diameter region near one of the support arms 18, and a set screw 52 threadably extends into such cavity to forcibly secure and clamp the support arm 18 into a selected position. Similarly, a threaded cavity extends longitudinally from such end of the shaft 12, and a set screw 54 extends into the cavity to forcibly clamp the other support arm 16 into a selected position.

A third collar 56 is adapted to surround the shaft 12 adjacent to the bracket 38 on the side of the bracket that is opposite to the collar 44. A threaded cavity readily extends through the collar 56 and is adapted to receive a screw 58 such that by tightening the screw the collar 56 is clamped against the shaft 12 for concurrent rotation therewith.

A threaded cavity readily extends through the collar 56 at a point preferably diametrically opposite to the threaded cavity adapted to receive the screw 58. This diametrically opposite threaded cavity is adapted to receive a threaded pivot pin 60. The threaded pivot pin 60 is preferably surrounded by a tubular element 62 fashioned of rubber or other elastomeric material or of a material that may be resiliently compressed, such as soft plastic or leather.

A set screw 64 laterally extends into a corresponding threaded cavity in the bracket 38 approximately midway up and toward the rearward side of the bracket 38, on the side of the bracket 38 opposite to the coil spring 46. It will be appreciated that the tubular element 62 surrounding the pivot pin 60 will rotate and abut the set screw 64, thereby limiting the rotation of the pivot pin 60 and the rotation of the shaft 12. It will be appreciated that the set screw 64 acts as a limit surface preventing further arcuate rotation of the pivot pin 60.

The fall away arrow rest of the present invention also includes a generally rectangularly shaped block 66 with a substantially slanted or inclined top surface, as best shown in FIG. 4. A hole laterally extends through the block 66, through which a screw 68 is adapted to extend, which screw 68 is adapted to further extend into a corresponding threaded cavity within the bracket 38 about midway up and toward the forward region of the bracket 38, on the side opposite the coil spring 46. The block 66 may freely rotate about the shaft of the screw 68.

A tab or patch 70 is mounted on the rearward side of the block 66, such as by an adhesive. The patch 70 may be fashioned of leather, rubber, or other elastomeric material, or another material which, when suddenly contacting metal, will not make a noise, as will be more fully appreciated in the discussion later herein.

The fall away arrow rest of the present invention also includes a cord 72 preferably fashioned of a flexible material, and preferably a material that is essentially inextensible. Although the cord may comprise a single unlooped stand of material, preferably the cord 72 is looped. One end of the looped cord 72 is looped in a full hitch knot beneath the head of the pivot pin 60, and the other end of the cord 72 is looped about one of the cables of a compound bow. It should be appreciated that from further discussion herein that the cord 72 could also be looped less preferably around the bowstring of a bow. Preferably, the cord 72 is looped around the downwardly acting tuning cable of a compound bow, as best shown in FIGS. 5 and 6.

Figure 6:
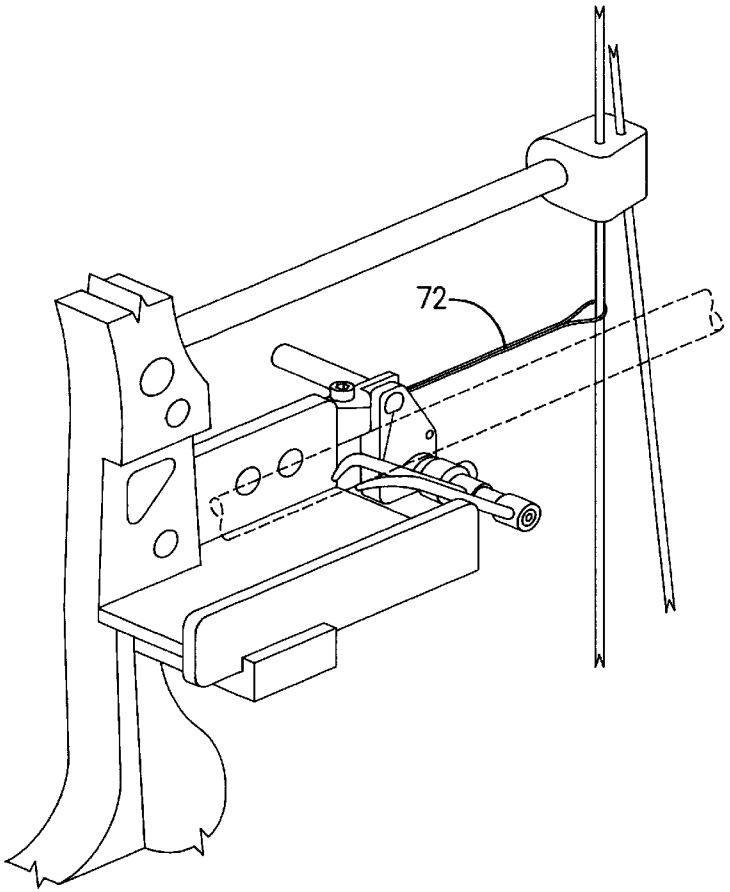
FIG. 6 is a detailed isometric view of a portion of the compound bow and arrow rest assembly shown in FIG. 5.
Figure 5:
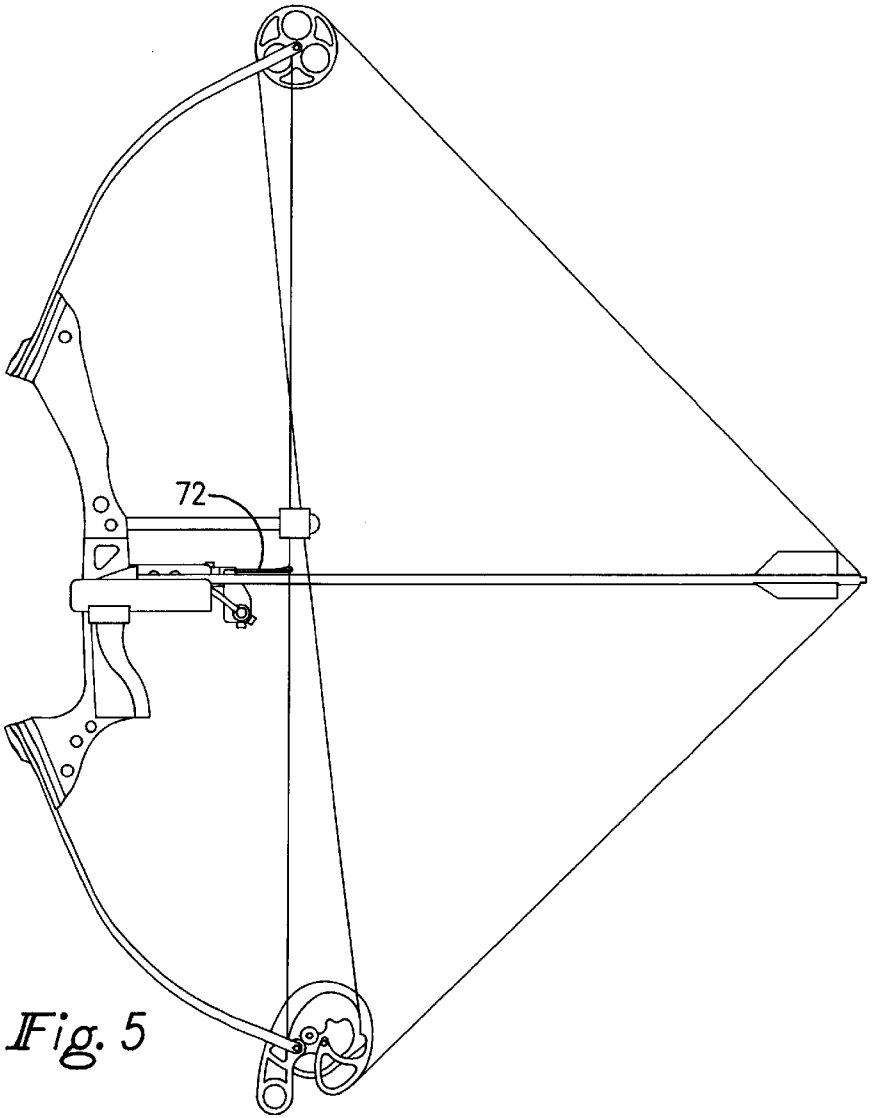
FIG. 5 is an elevation view of a compound bow with the arrow rest in an almost fully drawn position.

FIGS. 5 and 6 show the fall away arrow rest of the present invention mounted on what is known as an overdraw bracket or assembly, which is a well-known device in the archery field.

It will be appreciated from a description of the foregoing fall away arrow rest that the device is reversible in the sense that it may be adapted equally for either right-handed or left-handed archers.

The operation of the fall away arrow rest of the present invention will now be described.

Figure 2B:
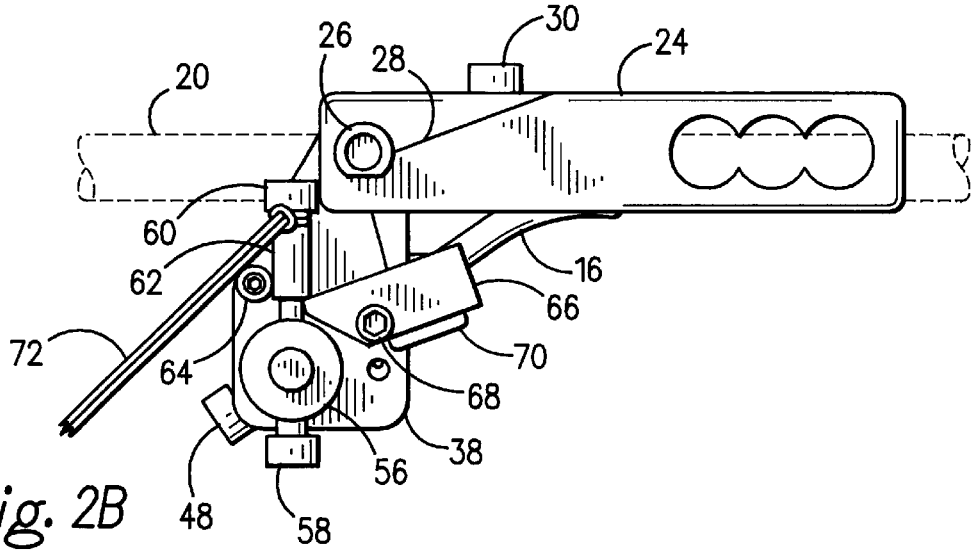
FIG. 2B is a schematic side elevation of the arrow rest as shown in FIGS. 1 and 2A, from the side opposite the side shown in FIG. 2A.

The archer manually pulls cord 72 rearwardly, such that the tubular element 62 overlying the pivot pin 60 abuts the set screw 64, which in turn causes the support arms 16, 18 to be rotated into a relatively high, upward position. While the archer continues to pull the cord 72, the archer manually rotates the block 66 about the screw 68 so that the upper comer of the block 66 engages the tubular element 62 on the side opposite to the set screw 64, as best shown in FIG. 2B. The block 66 will be maintained in a position shown in FIG. 2B when the archer releases tension on the cord 72 due to the bias of the spring 46 acting upon the pivot pin 60, which biases the pivot pin 60 and the associated tubular element 62 in a forward direction as shown in FIG. 2B.

The archer then places an arrow on the support arms 16, 18 of the arrow rest and draws the bowstring. The length of the cord 72 is selected such that just before the bowstring is at fill draw position the cord 72 will become taut and further drawing of the bowstring will compress the tubular element 62 against the screw 64, which will concurrently cause the block 66 to be disengaged from the tubular element 62. Such disengagement will immediately cause the block 66 to rotate about the screw 68 due to the weight imbalance of the block 66 about the screw 68. When the block 66 rotates about the screw 68, the patch 70 will contact the collar 56. Because of the relatively soft, resilient quality of the patch 70, the contact of the patch with the collar 56 will not cause any noise.

The cord 72 is selected with a length such that the cord 72 becomes taut when the bowstring is approximately one to four inches short of full draw, and more preferably two to three inches short of full draw, at the nocking point of the arrow nock with the bowstring. It will also be appreciated that as the bowstring is drawn to a fill draw position, whereupon the tubular element 62 is compressed against the set screw 64, the pivot pin 60 will move at a very slight rotational angle rearwardly (from the position shown in FIG. 2B), which also will translate through the shaft 12 to cause a corresponding slight angular rotation of the support arms 16, 18. Preferably such angular rotation will be less than 5 degrees and preferably less than 2 degrees. It will also be appreciated that the tips of the support arms 16, 18 will raise slightly vertically in the window of the bow 10 when the bow is drawn to a full draw position.

Figure 3A:
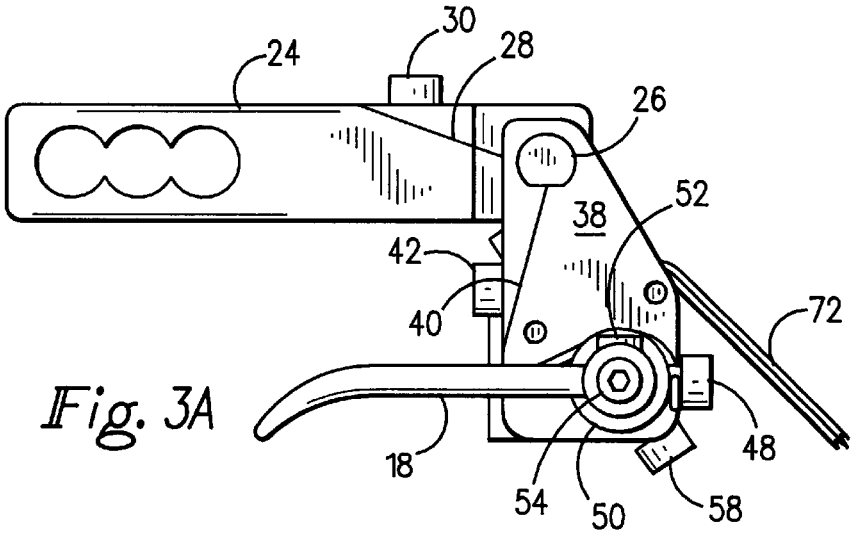
FIG. 3A is a schematic side elevation of the arrow rest as shown in FIG. 2A, after the arrow has been fired, showing a downward movement and rotation of the support arms.
Figure 3B:
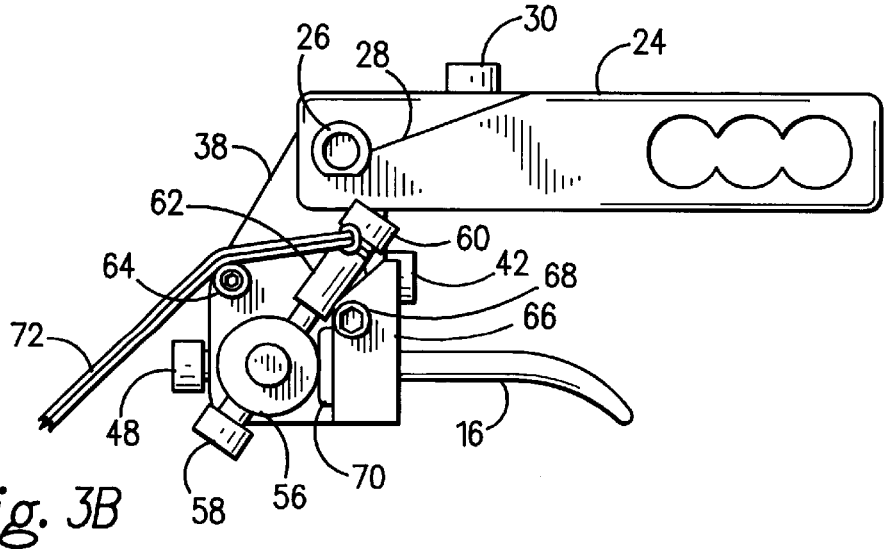
FIG. 3B is a schematic side elevation of the arrow rest as shown in FIG. 3A from a side opposite to that shown in FIG. 3A.

When the arrow is fired, the bowstring as well as the tuning cables move forwardly, immediately causing the cord 72 to become limp and causing the pivot pin 60 to move rotationally forward (from the position shown in FIG. 2B) and the support arms 16, 18 to rotate forwardly and downwardly, in response to the bias of the coil spring 46. The amount of forward and downward rotation of the support arms 16, 18 is preferably selected so that the support arms 16, 18 generally assume a horizontal position, as best shown in FIGS. 3A and 3B. When the support arms 16, 18 are in such a position, there is virtually no opportunity for either the arrow shaft or the arrow vanes to contact the support arms 16, 18.

It will also be appreciated that as the pivot pin 60 rotates forward in response to the bias of the coil spring 46, the tubular element 62 will contact the block 66, as best shown in FIG. 3B. Because the tubular element 62 is preferably resiliently compressible, the contact of the tubular element 62 with the block 66 will not create any noise. Also, the contact of the tubular element 62 with the block 66 limits the forward and downward rotation of the support arms 16, 18.

The present invention contemplates that instead of a pivot pin and block mechanism, a ratchet and pawl system may be utilized. Also, instead of the comer of the block 66 compressing against the tubular element 62, the comer of the block 66 may be disposed beneath the lip of the tubular element 62 (as is shown in FIG. 2B), or the comer of the block 66 could be disposed beneath the threads of a screw or bolt.

It will be appreciated that the relative noiseless, quiet operation of the fall away arrow rest of the present invention is especially suited for archery hunting of game.

Although particular embodiments of the present invention are described and illustrated herein, it should be recognized that modifications and variations may readily occur to those skilled in the art and that such modifications and variations may be made without departing from the spirit and scope of our invention. Consequently, my invention as claimed below may be practiced otherwise than as specifically described above.

What is claimed is:

1. A fall away arrow rest adapted to be mounted on a compound bow including an arrow window, at least one tuning cable, and a bowstring, said arrow rest comprising:

a substantially laterally extending rotatable shaft;

at least one launcher arm connected to, substantially pivotable about and rotatable with, and extending substantially upwardly and forwardly from said shaft and adapted to support the shaft of an arrow;

a spring for rotationally biasing said shaft such that said at least one launcher arm is rotationally biased toward a downward direction;

a post substantially rigidly connected to and substantially radially extending from said shaft whereby said post rotates with said shaft;

a first limit surface adapted to abut said post and to limit the rotation of said shaft in a first rotational direction whereby said launcher arm is in a substantially rotationally high position;

means for selectively maintaining said post in a first rotational position immediately adjacent to said first limit surface, during substantially the entire draw of the bowstring;

a flexible cord adapted to be connected to said post and to said at least one tuning cable such that when said bowstring is drawn to a first draw position substantially almost at, but not at, a full draw position, said maintaining means maintains said post in said first rotational position, and such that when said bowstring is drawn past said first draw position, said maintaining means ceases to maintain said post in said first rotational position and such that the firing of an arrow after said bowstring has been drawn past said first draw position causes said spring to rotate said shaft such that said at least one launcher arm rotates downwardly.

2. A fall away arrow rest according to claim 1 wherein said post includes a resiliently compressible material adapted to engage said first limit surface such that said maintaining means slightly compresses said post against said first limit surface and such that when said drawstring is drawn past said first draw position, said post is further, more forcefully compressed against said first limit surface.

3. A fall away arrow rest according to claim 2 wherein said at least one tuning cable moves rearwardly about one to five millimeters when said bowstring is drawn from said first draw position to said full draw position.

4. A fall away arrow rest according to claim 3 wherein said cord is substantially inextensible.

5. A fall away arrow rest according to claim 4 wherein the nocking point of said bowstring moves in the range of about one to four inches from said first draw position to said fall draw position.

6. A fall away arrow rest according to claim 2 wherein the nocking point of said bowstring moves in the range of about one to four inches from said first draw position to said full draw position.

7. A fall away arrow rest according to claim 1 wherein said maintaining means includes a block rotatable about an axle, said block possessing a contact surface such that when said block is rotated in a first direction, said contact surface forcefully engages said post and maintains said post in said first rotational position.

8. A fall away arrow rest according to claim 7 wherein said block is imbalanced about said axle such that when said bowstring is drawn past said first draw position, said block automatically rotates about said axle in a second rotational direction and said contact surface disengages said post.

9. A fall away arrow rest according to claim 8 wherein said block includes at least one corner and wherein said contact surface is essentially said corner.

10. A fall away arrow rest according to claim 9 wherein the nocking point of said bowstring moves in the range of about one to four inches from said first draw position to said full draw position.

11. A fall away arrow rest according to claim 8 wherein said at least one tuning cable moves rearwardly about one to five millimeters when said bowstring is drawn from said first draw position to said fill draw position.

12. A fall away arrow rest according to claim 11 wherein said cord is substantially inextensible.

13. A fall away arrow rest according to claim 12 wherein the nocking point of said bowstring moves in the range of about one to four inches from said first draw position to said full draw position.

14. A fall away arrow rest according to claim 8 wherein the nocking point of said bowstring moves in the range of about one to four inches from said first draw position to said full draw position.

15. A fall away arrow rest according to claim 7 wherein said block includes at least one corner and wherein said contact surface is essentially said corner.

16. A fall away arrow rest according to claim 15 wherein the nocking point of said bowstring moves in the range of about one to four inches from said first draw position to said full draw position.

17. A fall away arrow rest according to claim 7 wherein said at least one tuning cable moves rearwardly about one to five millimeters when said bowstring is drawn from said first draw position to said full draw position.

18. A fall away arrow rest according to claim 17 wherein said cord is substantially inextensible.

19. A fall away arrow rest according to claim 18 wherein the nocking point of said bowstring moves in the range of about one to four inches from said first draw position to said fall draw position.

20. A fall away arrow rest according to claim 7 wherein the nocking position of said bowstring moves in the range of about one to four inches from said first draw position to said full draw position.

21. A fall away arrow rest according to claim 1 wherein said cord includes a loop adapted to at least partially surround said at least one tuning cable.

22. A fall away arrow rest according to claim 1 wherein said at least one tuning cable moves rearwardly about one to five millimeters when said bowstring is drawn from said first draw position to said full draw position.

23. A fall away arrow rest according to claim 22 wherein said cord is substantially inextensible.

24. A fall away arrow rest according to claim 23 wherein the nocking point of said bowstring moves in the range of about one to four inches from said first draw position to said full draw position.

25. A fall away rest according to claim 1 wherein the nocking point of said bowstring moves in the range of about one to four inches for said first draw position to said full draw position.

26. A fall arrow rest adapted to be mounted on a bow, said arrow rest comprising:

at least one launcher arm adapted to support the shaft of an arrow and moveable between an uppermost position, a lower position, and an upper position intermediate said uppermost position and said lower position; and means for selectively maintaining said at least one launcher arm in said upper position during substantially the entire draw of the arrow.

* * * * *